US006401648B1

(12) United States Patent
Abbenhouse

(10) Patent No.: US 6,401,648 B1
(45) Date of Patent: Jun. 11, 2002

(54) KAYAK HATCH COVER

(76) Inventor: John Abbenhouse, 15145 NE. 90th St., Redmond, WA (US) 98052

( * ) Notice: Subject to any disclaimer, the term of this patent is extended or adjusted under 35 U.S.C. 154(b) by 0 days.

(21) Appl. No.: 09/928,575

(22) Filed: Aug. 10, 2001

Related U.S. Application Data

(60) Provisional application No. 60/224,859, filed on Aug. 11, 2000.

(51) Int. Cl.[7] ..... B63B 35/00
(52) U.S. Cl. ..... 114/347
(58) Field of Search ..... 114/347, 201 R, 114/203, 201 A

(56) References Cited

U.S. PATENT DOCUMENTS 6,073,574 A * 6/2000 King et al. ..... 114/364

* cited by examiner

*Primary Examiner*—Ed Swinehart

(74) *Attorney, Agent, or Firm*—J. Michael Neary

(57) ABSTRACT

A kayak is disclosed having a cockpit for holding a paddler and having a deck with at least one hatch. The exterior mold line of the kayak presents smooth sleek lines that are uninterrupted by a protruding hatch cover or by unsightly straps and buckles holding the hatch lid in place. The kayak has a cockpit for receiving a paddler and at least one cargo hold with a water tight bulkhead between the cargo hold and the cockpit. A hatch well in the deck has a floor recessed below the level of the deck. A hatch rim is bonded and sealed in a hatch opening in the hatch well floor, and a water tight hatch cover is fitted on the rim to seal the hatch against ingress of water into the cargo hold. A peripheral recess around the hatch well receives the peripheral edge of a hatch lid, dimensioned to fit into the peripheral recess and lie flush with the deck. Retention rods protruding into the recess fore and aft hold the hatch lid against movement out of the recess. One of the rods is axially movable under control of the paddler from the cockpit for releasing one edge of the hatch lid. The under-deck retention rods are hidden from sight so the hatch lid lies flush with the deck without straps or buckles or other hardware protruding above the mold line to disrupt and spoil the smooth sleek appearance of said kayak.

2 Claims, 8 Drawing Sheets

KAYAK HATCH COVER

This relates to U.S. Provisional Application 60/224,859 filed Aug. 11, 2000 and entitled "Kayak Hatch Cover".

This invention pertains to a kayak hatch lid, and more particularly to a hatch lid with a latch operated from inside the kayak cockpit for holding the hatch lid closed instead of the usual straps.

BACKGROUND OF THE INVENTION

Modern touring or expedition sea kayaks are all equipped with sealed fore and aft cargo holds in which camping gear and the like can be stowed during travel between camp sites, and retrieved dry for use in camp. The kayaks are provided with fore and aft covered hatches for access to the holds. Naturally, the hatch covers should be water tight to prevent ingress of water into the dry gear stowed in the holds. Unfortunately, the hatch covers are often poorly designed and they leak, resulting in water entering the cargo holds of the kayak. Water leakage into kayak cargo holds is now such a common experience that experienced kayakers always put their gear that must stay dry into water tight bags known as dry bags. Unfortunately, dry bags are bulky and stiff. They do not pack compactly into a cargo hold and effectively reduce the volume available for gear storage.

The conventional approach for designing a water tight hatch cover is to strap a rigid hatch cover with a peripheral seal over the hatch opening. This approach is often ineffective for several reasons. The strap provides sealing pressure in the vicinity of the strap, but the flexibility of the hatch cover allows it to flex and reduce the sealing pressure in regions at a distance from the strap. This becomes especially troublesome when waves are breaking on the deck of the kayak, resulting in instantaneous dynamic water pressure around the seal that is greater than the sealing pressure provided by the force of the strap spread over the seal area. In addition, the strap is often difficult to tighten sufficiently and is usually at an angle that is non-conducive to developing a normal sealing pressure with the rim of the hatch opening. The strap, even if tightened effectively at the beginning of the trip, can expand under the influence of water and heat from the sun and thereby lose its ability to exert an effective sealing force on the hatch cover.

Straps and strap buckles can interfere with the rescue of a kayaker who has capsized and is attempting to re-enter his kayak. Deep water re-entry usually involves slithering over the kayak deck while the kayak is held by a companion, or using a paddle float as a form of outrigger. Attempting to slither over a hatch cover strap buckle can result in catching clothing or a spray skirt on the buckle or strap which could interfere with movement into the cockpit. The buckle itself can also scratch or cut the skin of the kayaker who is attempting to stay as close to the deck as possible to maintain a low center of gravity.

The marketing of sea kayaks is very competitive and customers are attracted toward sleek and clean kayak lines. A protruding hatch cover and straps detracts from the sleek and clean beauty of a kayak and it would be a marketing benefit if the hatch cover could be made as unobtrusive as possible, preferably perfectly flush with the deck of the kayak and with no visible straps, buckles or latches to spoil the sleek lines of the kayak.

SUMMARY OF THE INVENTION

Accordingly, this invention provides a kayak hatch lid that is perfectly flush with the deck of the kayak and is releasably secured in a closed position by a mechanism that is hidden from sight and can be operated from inside the kayak cockpit.

The invention includes a water tight hatch cover recessed below the deck level in a shallow well, the floor of which has an opening into which a hatch rim is sealed. A rigid lid is fitted into a peripheral ledge around the well and covers the well and the hatch cover. The lid is flush with the top surface of the kayak deck.

DESCRIPTION OF THE DRAWINGS

The invention and its many attendant benefits and advantages will become better understood upon reading the following detailed description of the preferred embodiments in conjunction with the following drawings, wherein.

DETAILED DESCRIPTION OF THE PREFERRED EMBODIMENTS

Figure 2:
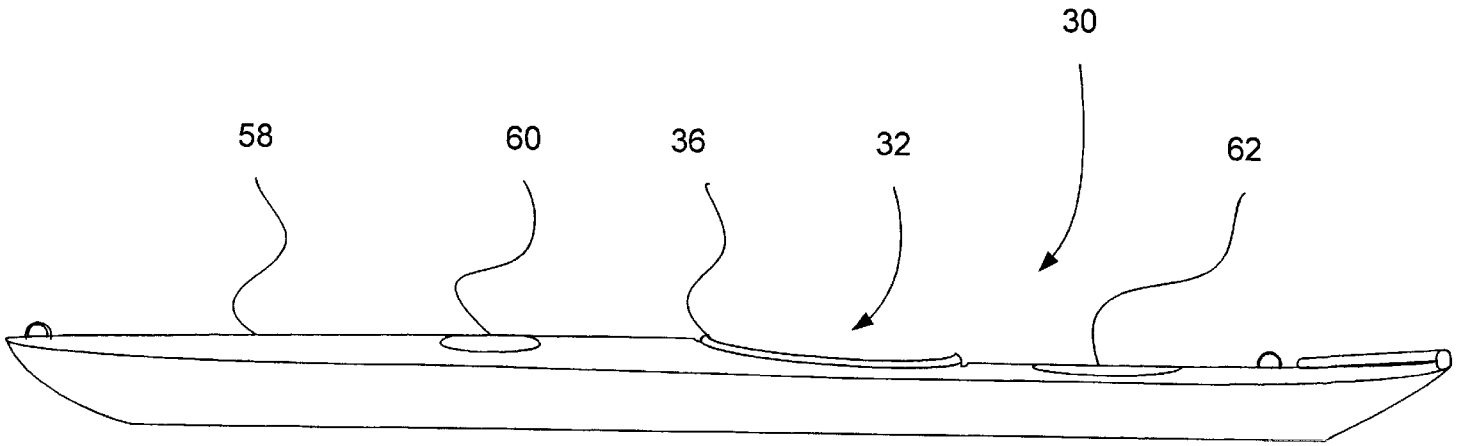
FIG. 2 is a side elevation of the kayak shown in FIG. 1.
Figure 1:
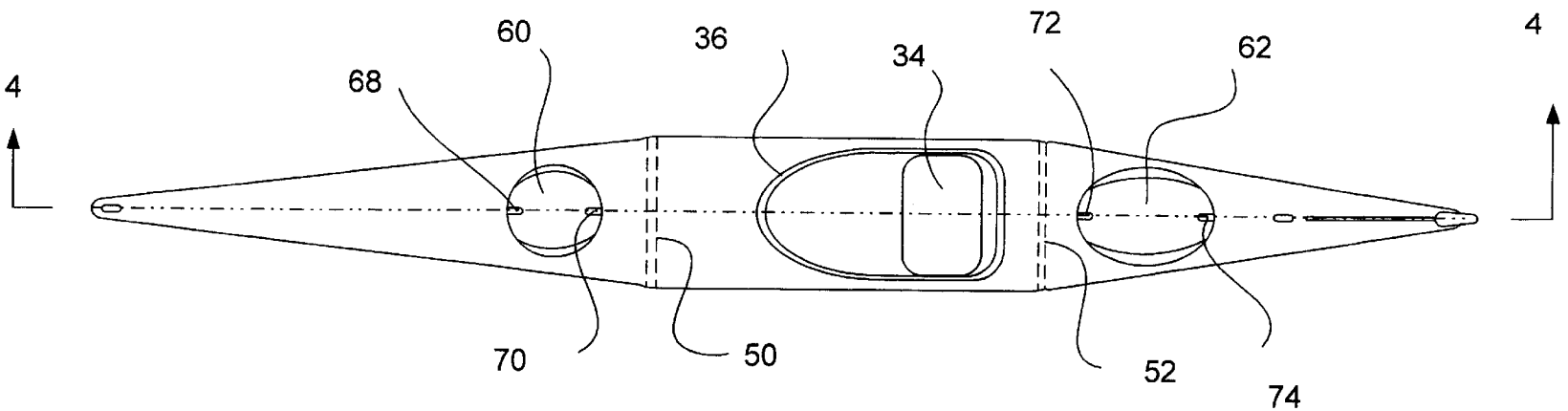
FIG. 1 is a plan view of a kayak having a hatch lid in accordance with this invention.
Figure 3:
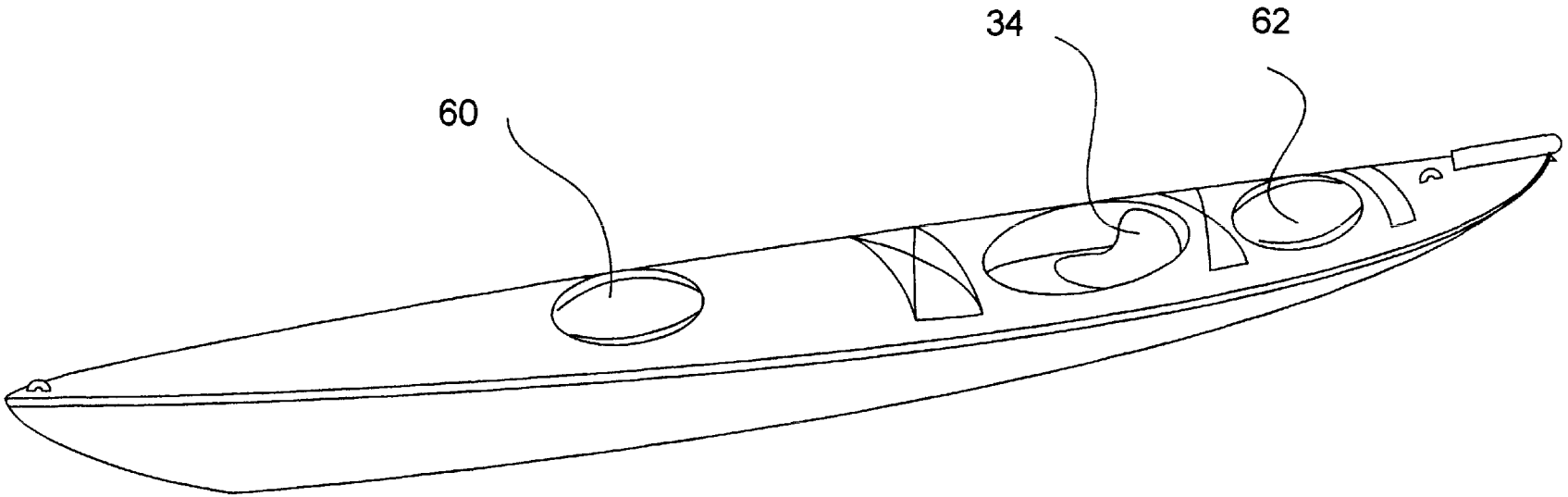
FIG. 3 is a perspective view of the kayak shown in FIGS. 1 and 2.

Turning now to the drawings, and more particularly to FIGS. 1–3 thereof, a kayak 30 is shown having a cockpit 32 with a seat 34 in which a kayaker sits with his legs extending forward. The cockpit has a raised combing 36 to allow an elasticized edge of a spray skirt (not shown) which the kayaker wears around his waist to overlap the lip of the combing 36 and prevent water from entering the cockpit.

Figure 4:
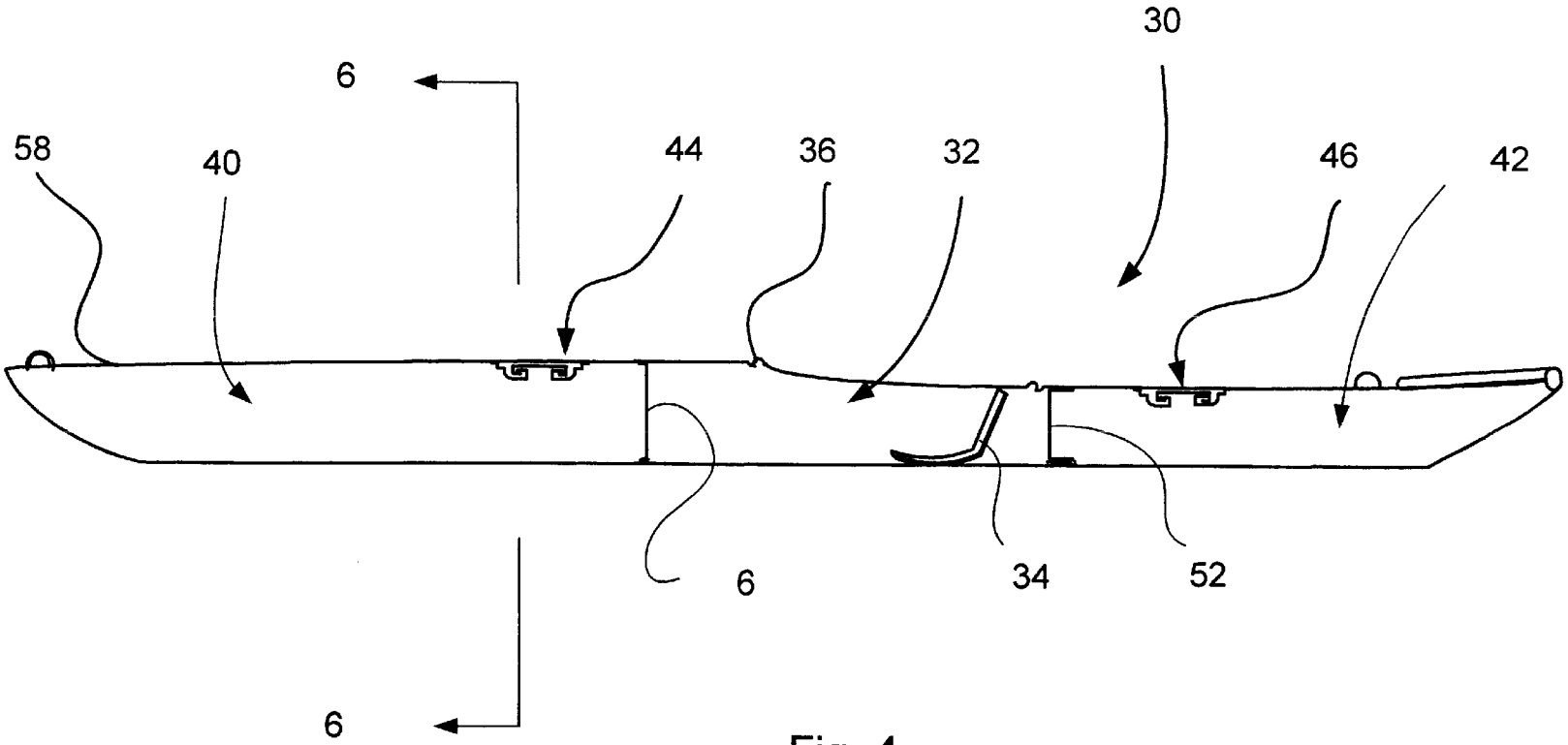
FIG. 4 is a sectional elevation along lines 4—4 in FIG. 1.

As shown in FIG. 4, a forward cargo hold 40 and a stern cargo hold 42 are accessible for stowing and retrieving cargo through a forward hatch opening 44 and a stern hatch opening 46. The forward cargo hold 40 is separated from the cockpit 32 by a water tight forward bulkhead 50 and the stern cargo hold 42 is separated from the cockpit 32 by a water tight stern bulkhead 52.

Figure 5:
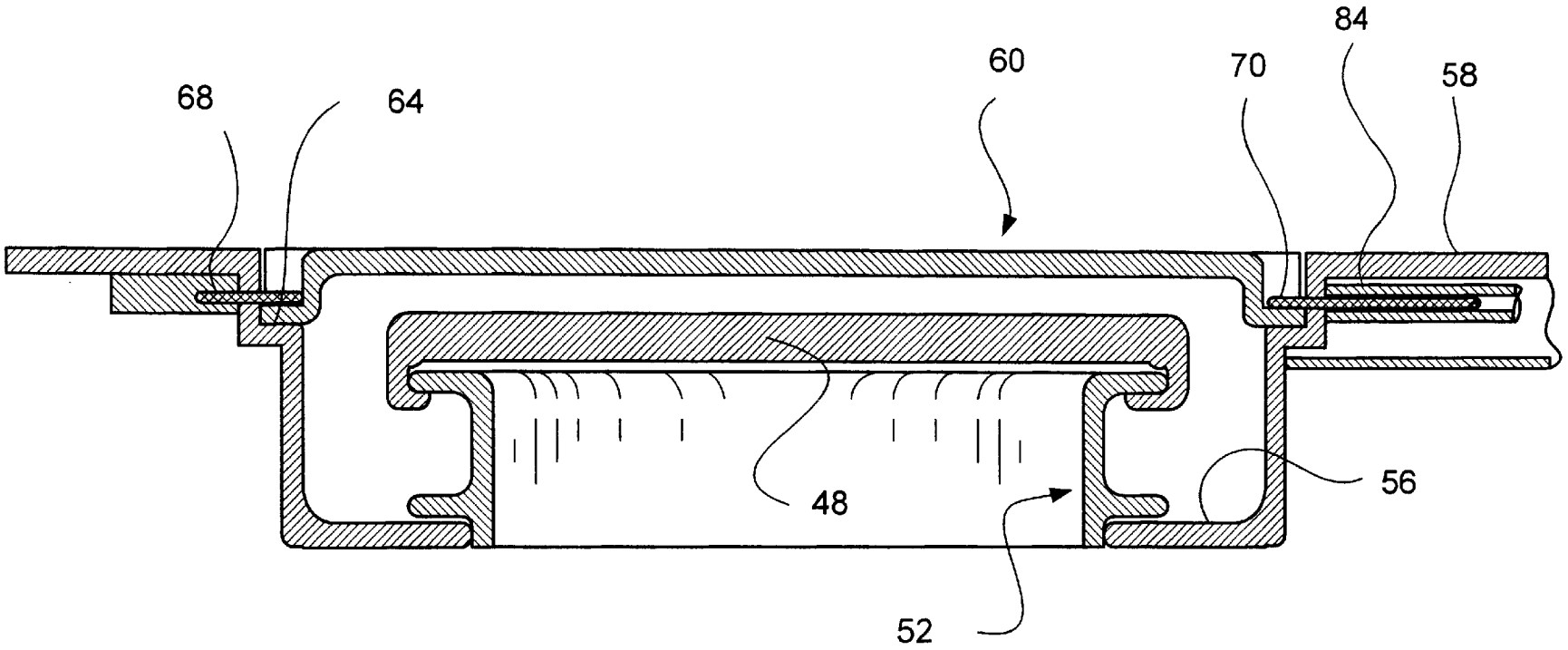
FIG. 5 is an enlarged side sectional elevation of the front hatch opening in the kayak shown in FIG. 4.
Figure 10:
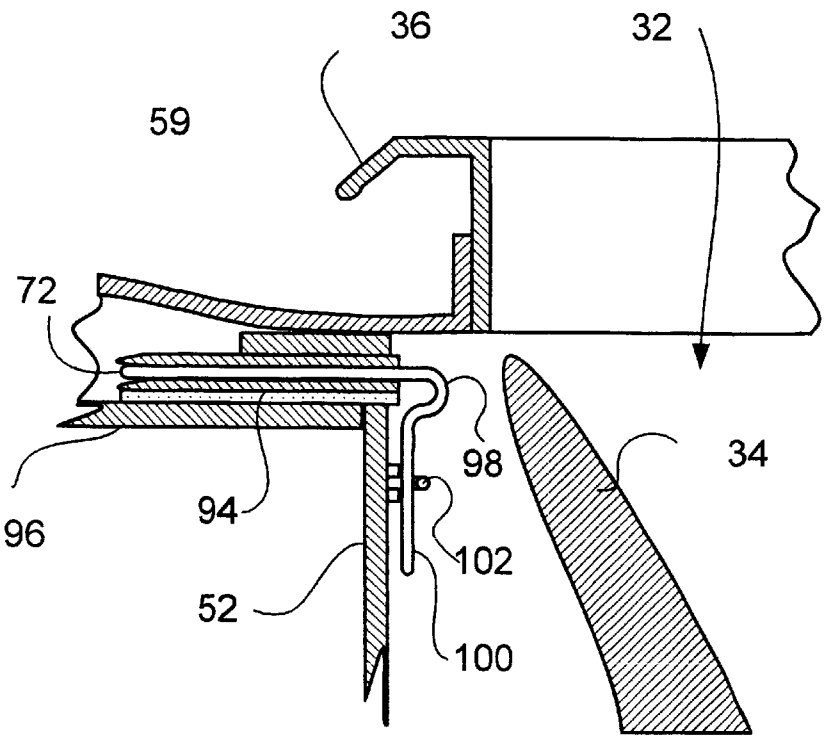
FIG. 10 is a sectional side elevation of the rear portion of the cockpit and the forward portion of the stem hatch opening in the kayak shown in FIG. 4.
Figure 10:
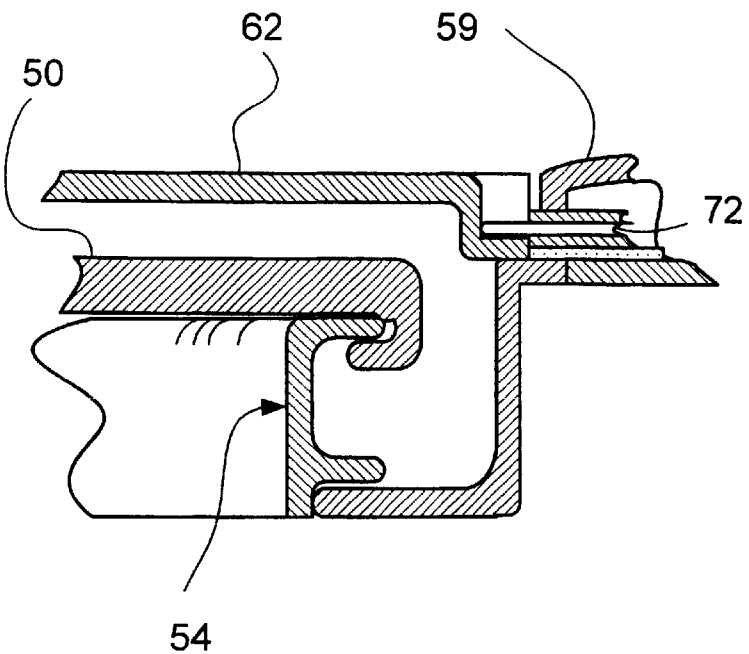

To prevent water ingress into the forward and stern holds 40 and 42, the hatch openings 44 and 46 are sealed with hatch covers, such as rubber hatch covers 48 and 50 made by Kajak Sport in Finland. As shown in FIGS. 5 and 10, the hatch covers 48 and 50 fit elastically onto hatch rims 52 and 54, also sold by Kajak Sport with the hatch covers 48 and 50. The hatch rims 52 and 54 are bonded and sealed into hatch openings in hatch wells 56 lying below the level of the top of the forward kayak deck 58 and the stern kayak deck 59. The elastic hoop stress of the hatch covers 48 and 50 when stretched onto the rims 52 and 54 provide a sealing pressure that is effective against all but powerful transient dynamic hydraulic pressure of a breaking wave on the deck.

Figure 6:
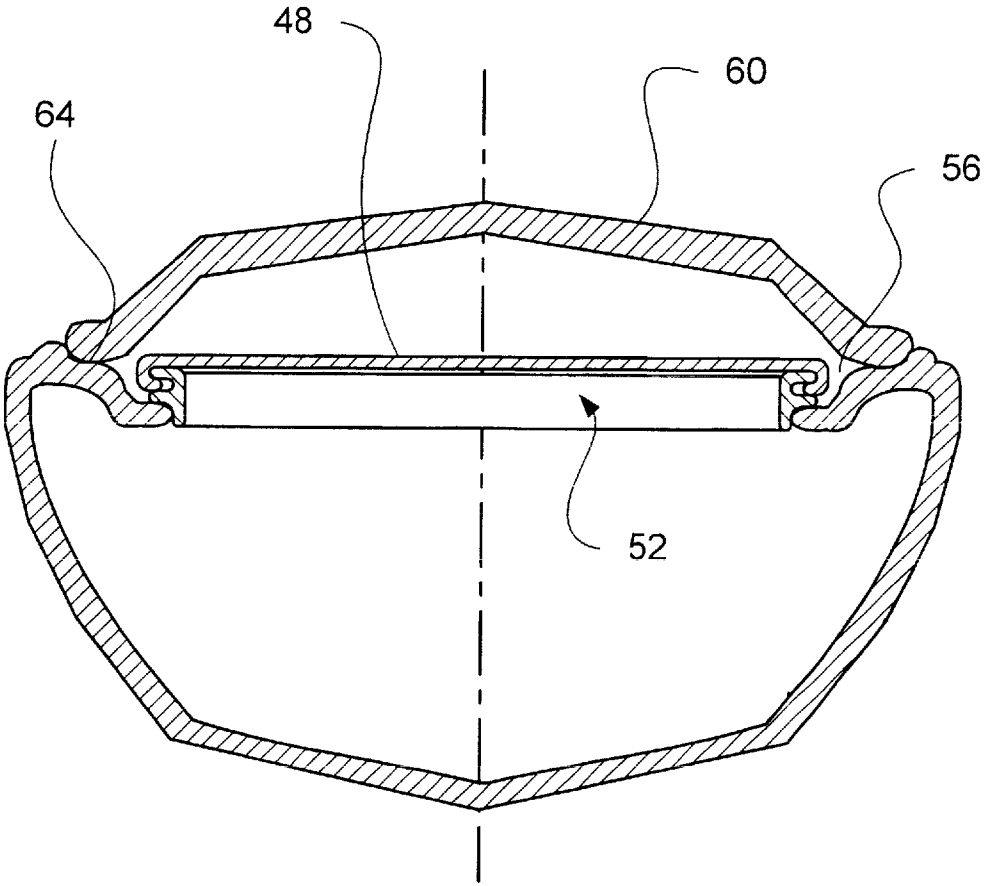
FIG. 6 is an end sectional elevation along lines 6—6 in FIG. 4.
Figure 7:
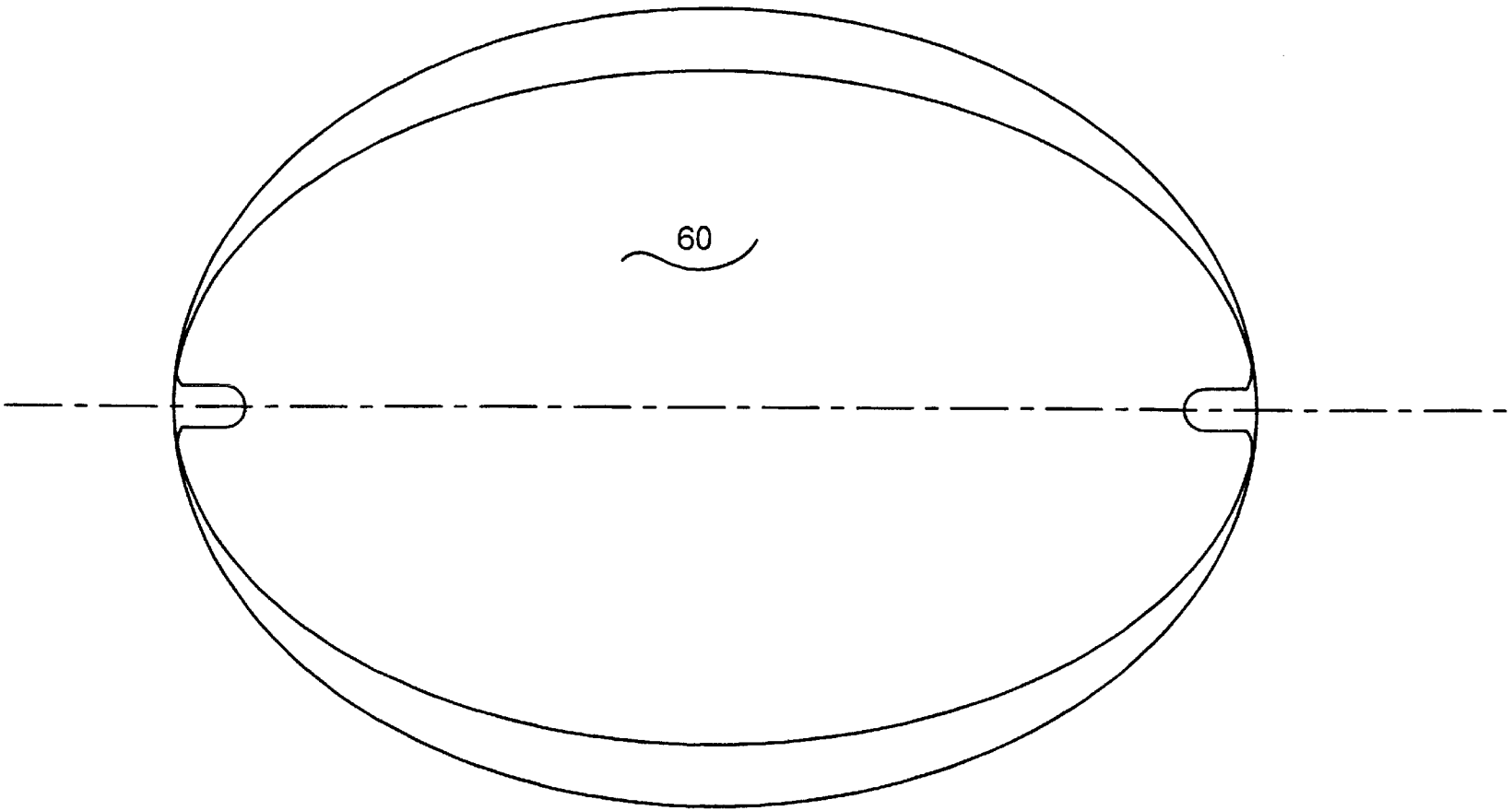
FIG. 7 is a plan view of the kayak hatch lid shown in FIGS. 5 and 6.

To isolate the forward hatch cover 48 from dynamic hydraulic pressure of a breaking wave, a forward hatch lid 60 is fitted into a recess 64 around the periphery of the hatch well 56 as shown in FIGS. 5 and 6, covering the hatch well 56 and isolating the hatch cover 48 from direct impact from the breaking wave. A similar hatch lid 62 is provided for the stern hatch in a similar peripheral recess 66 around a similar rear hatch well. The hatch lids 60 and 62 are shaped with the same profile as the kayak deck and lie perfectly flush with the deck, making them almost indistinguishable from the deck surface. The sleek and clean lines of the kayak are undisturbed by the flush hatch lids 60 and 62, and no straps or strap buckles are needed to hold the lids 60 and 62 in place in the recesses 64 and 66.

To prevent the lids 60 and 62 from being flushed out of the recesses 64 and 66 or being blown out while the kayak is being transported on the top of a car, two retaining rods 68 and 70 are provided on opposite axial sides of the front hatch lid 60, and similarly, two retaining rods 72 and 74 are provided on opposite axial sides of the stern hatch lid. As shown in FIG. 5, the forward retaining rod is fixed in a block of fiberglass and does not move. The rear retaining rod 70 is slidably mounted under the kayak deck and extends into the cockpit 32. The rods 70 and 72 have finger loops 80 and 98 by which they may be pulled to release the near edge of the hatch lids 60 and 62 for removal and access to the hatch covers 48 and 50.

Figure 8:
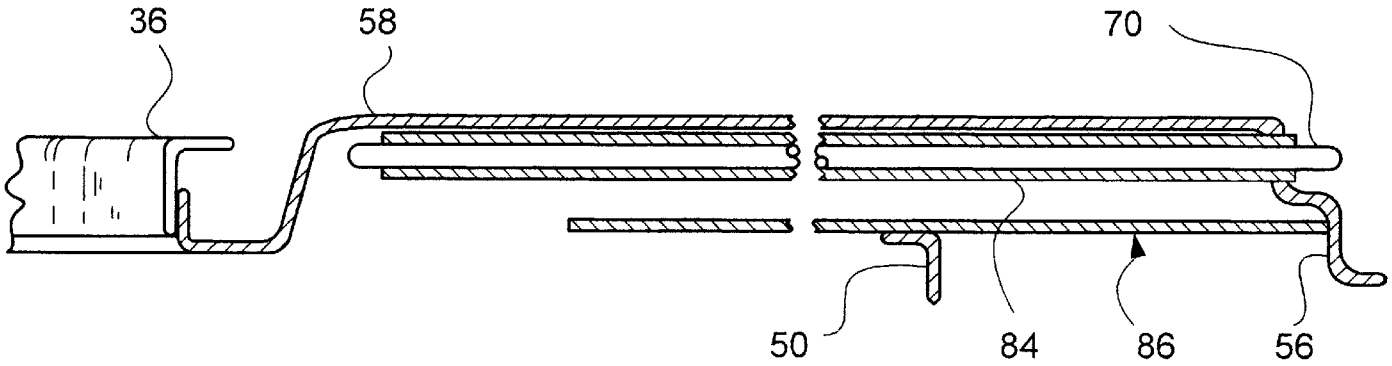
FIG. 8 is a sectional side elevation of the portion of the kayak deck and retaining rod of the kayak shown in FIG. 4 between the forward edge of the cockpit and the rear edge of the forward hatch.
Figure 9:
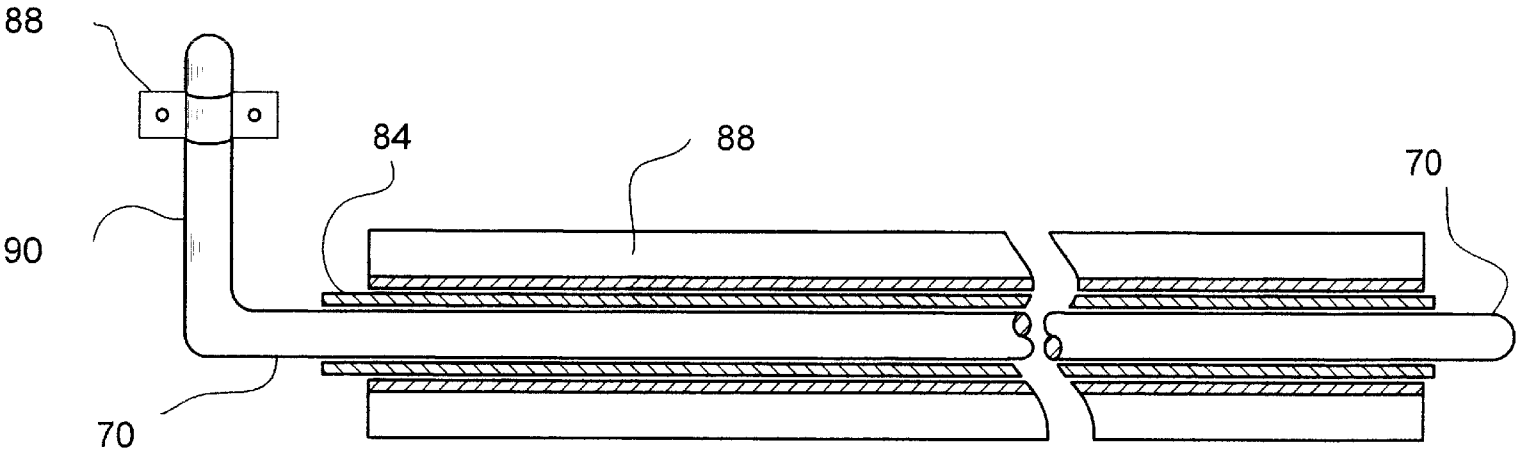
FIG. 9 is a plan view, looking up of the underside of the portion of the kayak deck and retaining rod shown in FIG. 8.

The mounting of the rear retaining rod 70 of the forward hatch lid 60, shown in FIGS. 8 and 9, utilizes a flexible tube 84 made of PVC or polyurethane or the like having in interior diameter slightly larger than the outside diameter of the rod 7. The rod slides freely in the tube 84, but the close fit of the rod 70 in the tube 84 effectively constitutes a labyrinth seal against flow of water from the forward hatch well 56 into the cockpit 32. A molded channel 86 having flanges 88 supports and encapsulates the tube 84 and its rod 70, and prevents the tube 84 and rod 70 from being damaged by inadvertent snagging damage by the kayaker in the cockpit 32 or cargo in the cargo hold 40. The channel 86 is bonded to the underside of the kayak deck 58 by a polyurethane sealant/adhesive which also seals the tube 84 to the opening in the hatch well 56 through which the tube 84 and the rod 70 extend.

The rod 70 is bent at a right angle at its end nearest the combing 36 and is fixed in a U-bracket 88 to the underside of the kayak deck 58, as shown in FIG. 8. The right angle leg 90 of the rod 70 is bent in a U-shape to provide a finger loop by which the rod can be pulled to the rear to release the rear edge of the hatch lid 60. The rod 70 is molded polyurethane so it is flexible and bends without difficulty at the right angle bend, providing the axial spring action on the rod 70.

The stern hatch lid 62 is latched by a forward retaining rod 72 and a fixed rear retaining rod 74, like the hatch lid 60. The forward retaining rod 72 lies in a flexible tube 94 that is supported and sealed in a flanged channel 96 in the same way that the tube 84 is supported and sealed for the front hatch lid 60. The front end of the rod 72 is bent at a right angle with a finger loop 98 and the end 100 of the rod 72 is secured to the rear bulkhead 52 by a U-bracket 102.

Pulling the finger loop 98 bends the rod 72 at the right angle bend around the finger loop 98 and withdraws the stem end of the rod 72 from its position capturing the front edge of the hatch lid 62, freeing the front edge of the hatch lid 62 and allowing it to be lifted and its rear edge to be pulled from under the fixed retaining rod 74, exposing the rear hatch cover 50.

Obviously, numerous modifications and variations of the preferred embodiment described above are possible and will become apparent to those skilled in the art in light of this specification. Moreover, many functions and advantages are described for the preferred embodiment, but in many uses of the invention, not all of these functions and advantages would be needed. Therefore, I contemplate the use of the invention using fewer than the complete set of noted features, process steps, benefits, functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species.

Accordingly, it is expressly intended that all these embodiments, species, modifications and variations, and the equivalents thereof, in all their combinations, are to be considered within the spirit and scope of the invention as defined in the following claims, wherein I claim:

1. A kayak having a cockpit for holding a paddler and having a deck with at least one hatch and an exterior mold line presenting smooth sleek lines, comprising:

a hatch well having a floor recessed below the level of said deck;

a hatch rim in said floor and a water tight hatch cover on said rim;

a peripheral recess around said hatch well for receiving the peripheral edge of a hatch lid;

a hatch lid dimensioned to fit into said peripheral recess and lie flush with said deck;

retention rods protruding into said recess fore and aft to hold said hatch lid against movement out of said recess;

at least one of said rods being axially movable under control of said paddler from said cockpit for releasing at least one edge of said hatch lid;

whereby said hatch lid lies flush with said deck without straps or buckles protruding above said mold line to disrupt and spoil the smooth sleek appearance of said kayak.

2. A process for protecting a cargo hold of a kayak from water ingress and providing a clean profile of a deck of said kayak free for external attachment devices above the upper surface of said kayak deck, comprising:

securing an elastomeric hatch cover onto a rim of a hatch opening into said cargo hold to provide a seal sufficient to prevent ingress of water at low static head pressure; and securing a hatch lid over said hatch cover to break the force of breaking waves on said kayak and isolate said elastomeric hatch cover from high momentary dynamic water pressure in said breaking wave;

said securing of said hatch lid includes engagement of latch rods with said hatch lid below said kayak upper surface to preserve said clean profile of said kayak deck.

* * * * *